US005353573A

United States Patent [19]

Durrant

[11] Patent Number: 5,353,573

[45] Date of Patent: Oct. 11, 1994

[54] APPARATUS AND METHOD FOR FORMING, FILLING AND SEALING CLOSED INDIVIDUAL PINCH POUCHES

[75] Inventor: William J. Durrant, Oak Forest, Ill.

[73] Assignee: Unique Packaging, Inc., Ill.

[21] Appl. No.: 948,838

[22] Filed: Sep. 16, 1992

[51] Int. Cl.[5] ..... B65B 7/06; B65B 43/04; B65B 57/02; B65B 61/00

[52] U.S. Cl. ..... 53/410; 53/455; 53/479; 53/481; 53/64; 53/133.1; 53/562; 53/374.8; 53/375.3

[58] Field of Search ..... 53/64, 284.7, 374.8, 53/375.3, 385.1, 133.1, 410, 455, 479, 481, 550, 562

[56] References Cited

U.S. PATENT DOCUMENTS

| | | | |
|---|---|---|---|
| 2,649,674 | 8/1953 | Bartelt | 53/562 |
| 2,745,583 | 5/1956 | Harker | 53/385.1 |
| 3,083,876 | 4/1963 | Schneider et al. | 53/550 X |
| 3,505,778 | 4/1970 | Cloud et al. | 53/562 |
| 3,667,188 | 6/1972 | Benner et al. . | |
| 3,930,350 | 1/1976 | Reid | 53/562 X |
| 3,952,480 | 4/1976 | Nordstrom | 53/562 |
| 4,216,639 | 6/1972 | Gautier . | |
| 4,232,504 | 11/1980 | Dieterlen et al. | 53/562 X |
| 4,344,269 | 8/1982 | Dieterlen et al. . | |
| 4,394,936 | 7/1983 | Shavit . | |
| 4,604,850 | 8/1986 | Reil . | |
| 4,614,079 | 9/1986 | Ida et al. | 53/375.3 X |
| 4,631,901 | 12/1986 | Chung et al. | 53/562 X |
| 4,669,253 | 6/1987 | Shavit . | |

*Primary Examiner*—Linda B. Johnson
*Attorney, Agent, or Firm*—Anthony S. Zummer

[57] ABSTRACT

A machine and method for forming, filling and sealing closed individual pinch pouches includes a support for holding a continuous supply of material having a solid bleached sulfate board or paper board surface and a heat sealable plastic coating on one side. A folding apparatus folds the web material onto itself with the heat sealable surface facing itself with a gusset at the fold. Drive rollers pull the material from the source through the folding apparatus. Heating bars form a seal between selected portions of the material by sealing the heat sealable surfaces at intermittent portions. A cutter cuts the material through the seal and forms a blank having opposed sealed edges extending to the gusset and an open edge opposite the gusset. A hammer pushes the gusset of the blank inward to spread apart opposed surfaces of the blank. An injector forces a flowable substance into the blank through the open edge. A sealer engages the open edge opposite the gusset to force a selected area of the edge together to form a sealed closed pinch pouch.

38 Claims, 4 Drawing Sheets

30
31
32
41
42
47
54
56
58
60
62
92
94
100
104
106
108
111
112
113
114
115

APPARATUS AND METHOD FOR FORMING, FILLING AND SEALING CLOSED INDIVIDUAL PINCH POUCHES

SUMMARY OF THE INVENTION

The present invention relates to an apparatus and a method for forming, filling and sealing closed individual pinch pouches. A support holds a supply of web material in a roll which material has a heat sealable surface on one side and printed indicia on the other side. The web of material engages a plow for folding the material onto itself with one portion of the heat sealable surface facing another portion of the heat sealable surface with the indicia on the exterior of the folded material. A gusset is formed at the fold between the folded portions of the heat sealable surface. Drive rollers pull the material from the roll of material. A pair of preheating sealing bars engage the folded material to preheat a portion of the heat sealable surface, and a second pair of heat sealing bars engage the preheated portion to fuse the heat sealable material at a selected location to form a seal extending from the gusset across the direction of movement of the material. A blade is positioned between the margins of the material to provide an extended opening between sealed portions. The material is mounted in a transfer clamp. A cutter cuts the material through a seal to form a folded blank having opposed sealed edges extending to the gusset and an open margin opposite the gusset. A hammer pushes the gusset inward to spread apart opposed surfaces. A vacuum opener holds apart the open margins of the blank, and an injector forces a flowable substance including liquid into the blank through the open margins. Heat sealing bar engages the blank at the margins opposite the gusset to seal closed the open portion. A cooling bar engages the sealed margins, and a cutter cuts the sealed margins to form a nozzle in the blank and complete the pinch pouch.

DETAILED DESCRIPTION

Figure 1:
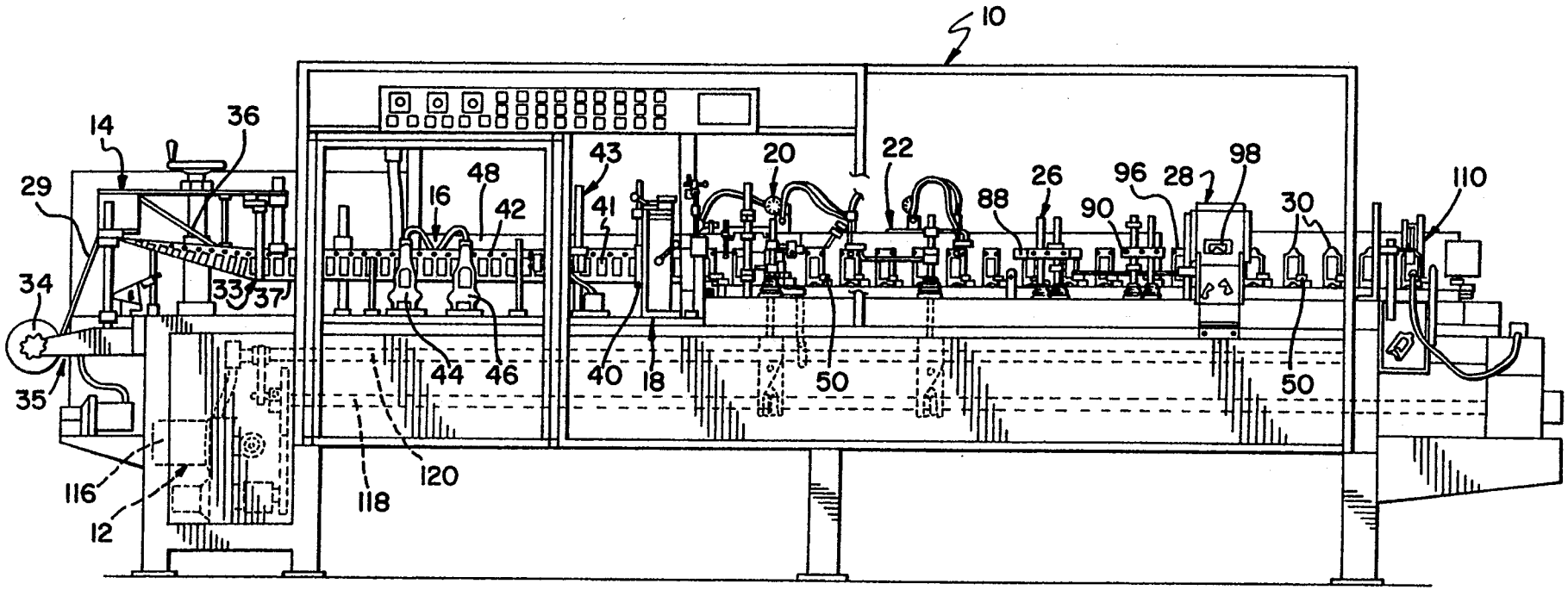
FIG. 1 is a side elevation view of an apparatus for forming, filling and sealing closed individual pinch pouches embodying the herein disclosed invention.
Figure 3:
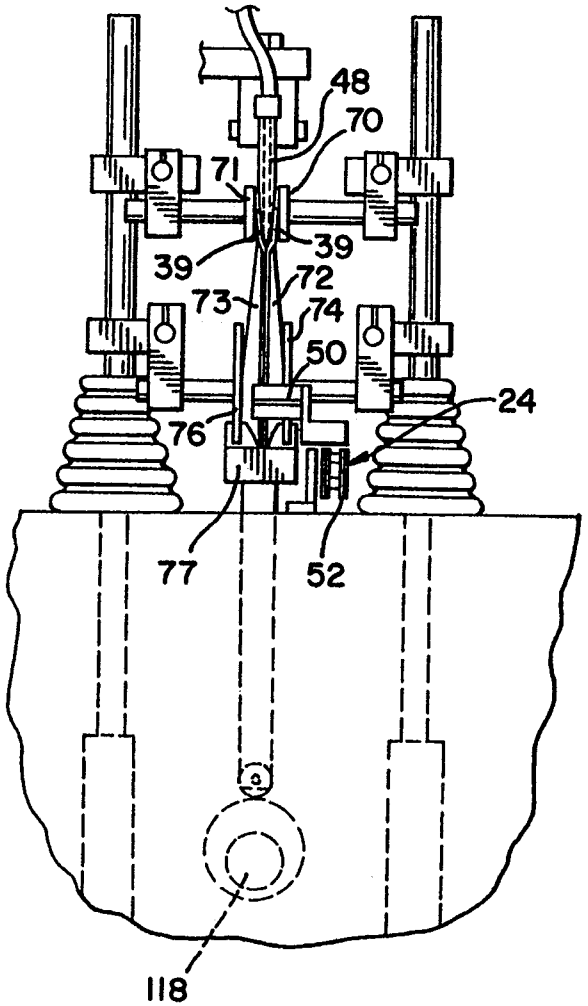
FIG. 3 is an end view of the portion of the apparatus shown in FIG. 2.
Figure 2:
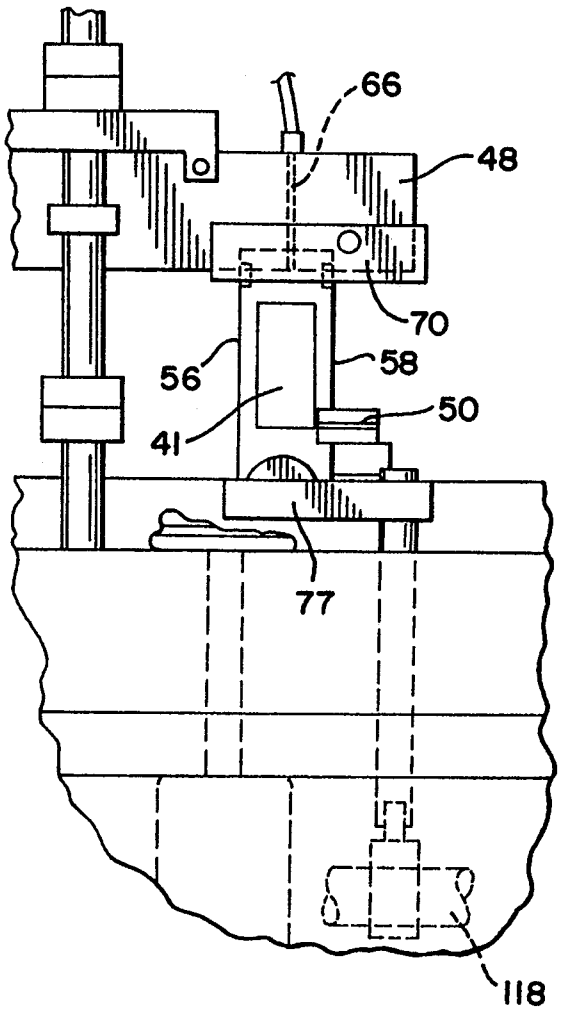
FIG. 2 is an enlarged fragmentary portion of a portion of the apparatus of FIG. 1 showing a hammer in engagement with a blank for pushing a portion of a gusset inward to open interiorly the blank.
Figure 5:
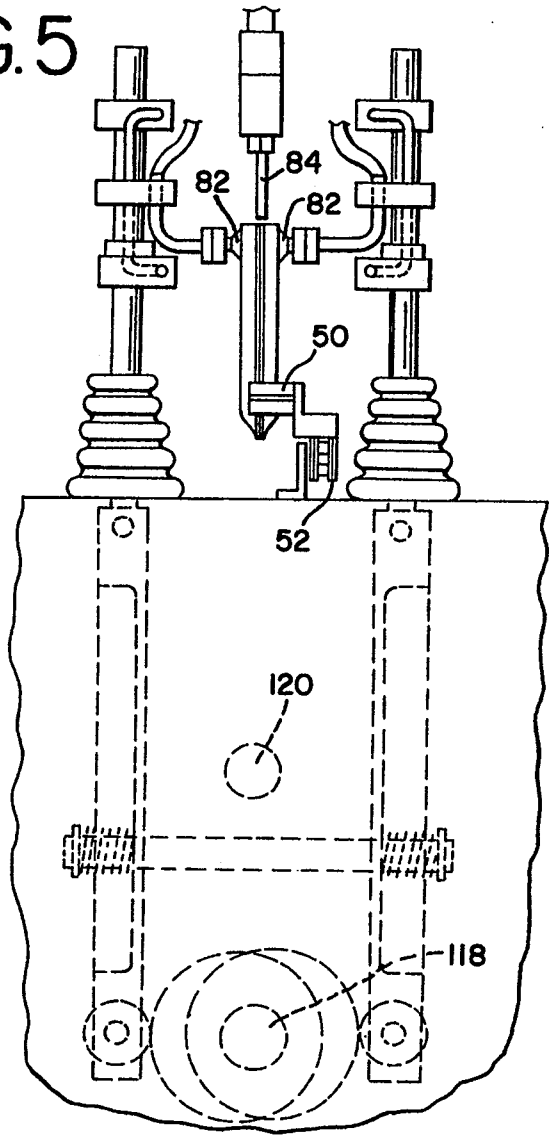
FIG. 5 is an end view of a portion of the filling station of FIG. 4.
Figure 4:
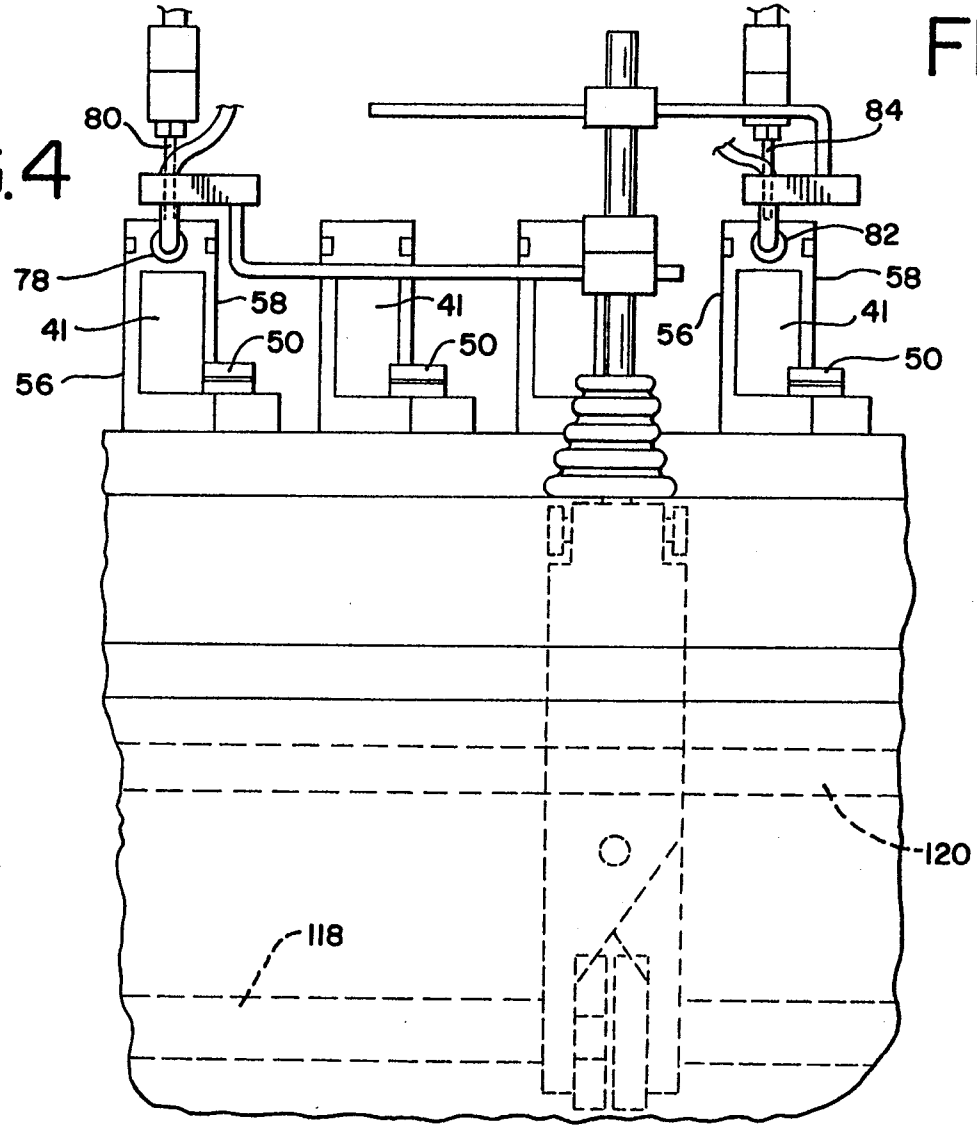
FIG. 4 is an enlarged fragmentary view showing a filling station of the apparatus shown in FIG. 1.

Referring now to the drawings and especially to FIG. 1, an embodiment of the present invention, namely, an apparatus for forming, filling and sealing closed individual pinch pouches is shown therein and is generally indicated by numeral 10. Apparatus 10 generally includes a power assembly 12, a stock assembly 14, a sealing section 16, a cutting section 18, a forming section 20, a filling assembly 22, a carrier assembly 24, a closure section 26, and a final die cutting section 28.

A web material 29 is formed and cut to make individual pinch pouches 30. The web material is a continuous roll of board including solid bleached sulfate board or paper board material having on one side a heat sealable surface which is a layer of polyethylene 32. Printing indicia 33 is on the other side of the cardboard. The thickness of the web material is greater than 7 mils, and in this instance, is 13 mils which is more than twice as thick as the material which is used heretofore for similar pinch pouches. The advantages of the thicker material will become readily apparent to those skilled in the art upon a consideration of the pinch pouch end product of the subject apparatus and method. The stock material is provided in a roll 34 which is mounted on a conventional power driven web feed device 35. The material comes off the roll and passes through a conventional plow 36 so that the web material is folded substantially in half along its length in its direction of movement. The polyethylene layer 32 has one portion facing another portion and forming a fold 37 at the bottom as viewed in FIG. 1. The top portion has opposed free margins 39 of the material adjacent to each other. The web of material is drawn from the roll and through the plow by a pair of conventional drive rollers 40.

Printing indicia 33 on the SBS board or paper board material includes a plurality of spaced identifying or advertising matter blocks 41 extending along the length of the web. A register mark 42 is printed along the upper margin of the web of stock material above and between each pair of adjacent identifying or advertising matter blocks 41. Register mark 42 provides a means or indicia for a conventional optical scanner or detector 43 to detect the mark and control movement of the web material and parts of the apparatus.

Optical scanner 43 controls the output of the power assembly 12 so that the web material moves intermittently through sealing section 16. Sealing section 16 includes a pair of conventional preheaters or preheating bars 44 which are engageable with the web material. Heating and sealing bars 46 are spaced from the preheating bars 44. The web material moves from preheating bars 44 to heating and sealing bars 46. The optical scanner interrupts the movement of the web so that a register mark 42 is aligned with each of the bars. When the web stops moving, preheater bars 44 move toward the web to heat the material in the spaced section between adjacent identifying or advertising matter blocks 41 and thereby heat the polyethylene at that section of the heat sealable surface between the spaced blocks. Heating and sealing bars 46 also engage the web at the same location where the preheating bars had previously engaged the web. Heating and sealing bars 46 further heat the web material and apply a force to the opposed portions of the heat sealable surface of the web material to cause the opposed portions to seal to each other to form a sealed portion 47 extending from the fold toward the free margins of the web material substantially perpendicular to and across the direction of movement of the web material. A blade 48 is positioned between the free margins 39 of the web material parallel to the direction of movement of the web material to prevent the free margins from being sealed to each other and thereby provide an opening to the space defined by the fold and two sealed portions 47. The movement of the web is controlled so that the sealing occurs between the identifying or advertising matter blocks 41.

The web material with a plurality of elongated sealed portions 47 extending across the direction of movement of the web is delivered to cutting station 18. The end of the web is placed into engagement with a blank carrier 50 of the carrier assembly which includes a plurality of blank carriers 50 mounted on a conventional driven chain 52. The movement of the web and the chain is interrupted when stock material is placed into engagement with the carrier. A conventional and well known knife (not shown herein) cuts the web material through the middle of a sealed portion 47 to form two separate sealed edges 56 and 58, thereby forming a blank 54 which has material folded on itself with the polyethylene surface on the interior of the fold. The blank has a rectangular configuration defined by opposed sealed edges 56 and 58 on the sides, the top being a free edge 60 formed by the free margins 39 and the bottom, and a gusset 62 which is formed by the fold and is opposite free edge 60.

Blank 54 is carried to the forming section 20. The blade 48 has an air port 66 which provides into the blank a supply of compressed air from a conventional compressed air source being means for blowing air through the blade. The blank ends at the forming section. A pair of upper retainers 70 and 71 hold the side walls 72 and 73, respectively, in place at the margins 39. A pair of lower retainers 74 and 76 holds the lower portion of the blank in position. A hammer 77 engages the bottom of the gusset to push the gusset inward thereby expand the side walls of the blank.

The chain moves the formed blank to filling station 22. A pair of opposed vacuum heads 78 engages the upper portion of the blank adjacent to the margins 39. The vacuum heads are moved apart to open the free end of the blank thereby providing an open end. A suitable flowable substance, such as a liquid, is injected into the open end of the blank through a conventional nozzle 80 which is connected to a conventional liquid filler (not shown herein). The blank continues its intermittent movement to a second position of the filling section where a second pair of vacuum heads 82 engages the upper portion of the blank adjacent to the margins 39. Vacuum heads 82 are moved apart to insure that the upper portion of the blank is open. An additional amount of flowable substance is injected into the open blank by a second liquid filler (not shown herein) through a second nozzle 84.

Figures 6, 7, 8:
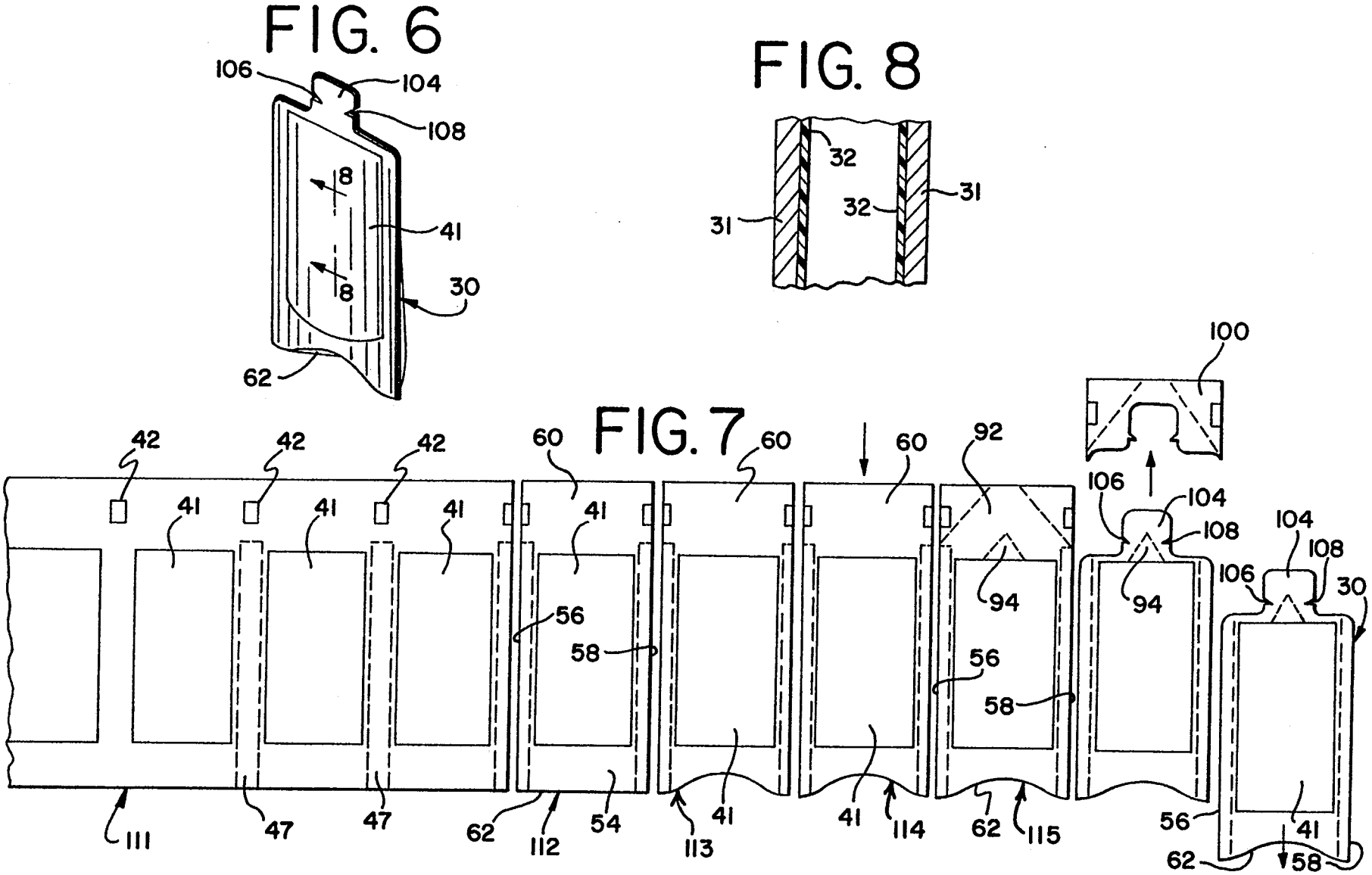
FIG. 6 is a perspective view of a completed pinch pouch made on the apparatus shown in FIG. 1.
FIG. 7 is a diagrammatic illustrative view showing the effects of various steps of the subject method after the web material is folded by displaying the various forms which the material takes as it goes through the apparatus of FIG. 1 going from the folded web material to a blank to a completed pinch pouch.
FIG. 8 is a cross sectional view through the completed pinch pouch of FIG. 6 taken on line 8—8 of FIG. 6.

The blank with its contents of the flowable substance is then carried by the chain to the closure section 26. Free margins 39 at the upper portion of the blank are heated by a pair of preheater bars 88. The chain moves the blank to a pair of upper edge heating and sealing bars 90 to seal off the open end. Clamps 90 further heat and squeeze the margins 39 to form a sealed portion 92 which is bounded by the generally arrow shaped dotted lines as is shown in FIG. 7. Sealed portion 92 extends into the two sealed edges 56 and 58. Sealed portion 92 includes a nonsealed portion 94 which communicates with the main portion of the interior of the blank. The blank moves to a cooler 96 where sealed portion 92 is cooled.

The blank with the contents sealed therein is carried into the die cutting assembly 28. A die 98 cuts off a trim portion 100. Removal of the trim portion from the blank completes pinch pouch 30. Pinch pouch 30 includes a nozzle 104 with a pair of notches 106 and 108 formed in opposite sides of the nozzle. Nonsealed portion 94 extends above notches 106 and 108 to allow the edge of the nozzle to be torn off at the notches and thereby provide an egress from the interior of the pinch pouch through the unsealed portion of the nozzle. Each completed pinch pouch is moved to a discharge assembly 110 where each pinch pouch is disengaged from its respective carrier and delivered to a conventional container which is not shown herein.

FIG. 7 is a condensed illustration of the transition of the web material from a folded web material to a completed pinch pouch 30 filled with flowable substance. Viewing the illustration from left to right, the first portion 111 shows a side view of the web material folded and with sealed portions 47. The next portion 112 illustrates the resulting formation of the blank by cutting through the middle of the sealed portion. The following part 113 shows the blank after the gusset has been forced inward. The succeeding part 114 depicts the blank ready to receive the flowable substance. The next part 115 is an example of the blank filled with the flowable substance and the sealed portion 92 closing the open end extending to the margin. The following portion of the illustration shows a completed pinch pouch and the trim portion 100 separated from the pinch pouch. The succeeding portion of the illustration shows a completed pinch pouch 30.

Power assembly 12 includes a conventional electric motor 116 which drives a pair of conventional shafts 118 and 120. The power to the shafts is delivered through conventional clutches. The optical scanner 43 controls the clutches so that the optical scanner can selectively interrupt the delivery of power to each of the shafts 118 and 120. The movement of the web material and the individual blanks is controlled by the optical scanner. When movement of the web and the blanks is interrupted, the various other parts of the apparatus are energized, that is, the heaters and the sealers squeeze the blanks as described above. The cutting operation is done at the same time. The blanks are also filled at the same time. Once the sealing, filling, forming operations are completed, the various elements disengage the blank in its various forms and the web of material and the blanks move to the next incremental station. The use of the two shafts allows the various operations to be effectively synchronized.

Pinch pouch 30 formed by the present apparatus and method is an improvement over those made heretofore from a continuous web of material. The instant pinch pouch is made of a stock having a thickness of 13 mils which is more than twice as thick as the material heretofore used in a continuous web of operation. The web material has a thickness of at least 7 mils. One of the advantages which flows from using the heavier web material is that when the pinch pouch is opened by tearing off the upper portion of nozzle 104 at the two notches 106 and 108 to expose the unsealed portion 94, material contained in the pinch pouch may be expelled by squeezing the pinch pouch. However, if all of the material is not used, or is not necessary, the mere release of pressure from the sidewalls of the pinch pouch allows the resilience of the material to close the opening. The natural resilience of the heavy material provides a resilient closure for the pinch pouch, thereby preventing unneeded and unnecessary dripping or oozing of the contents of the pinch pouch.

Although a specific embodiment of the herein disclosed invention has been shown in the accompanying drawings and described in detail above, it is readily apparent that those skilled in the art may make various modifications and changes in the herein disclosed apparatus and method without departing from the spirit and scope of the present invention. It is to be expressly understood that the instant invention is limited only by the appended claims.

I claim:

1. A method of forming, filling, and sealing closed individual pinch pouches of board material having a thickness greater than 7 mils comprising the steps of: removing from a source of supply a continuous web of board material having a thickness greater than 7 mils and having a heat sealable surface on one side and indicia on the other side, moving the web of board material in one direction, folding the board material along the direction of movement of the web with portions of the heat sealable surface facing to form a gusset at the fold, heating and squeezing a selected area of a portion of the heat sealable surface to form a seal in the area between opposed portions of the heat sealable material extending to the gusset across the direction of movement of the web of board material and terminating prior to an edge opposite the gusset, mounting a portion of the material on a carrier, cutting the material through the seal to form a folded blank having sealed opposed edges extending to the gusset and an open margin opposite the gusset, moving the gusset inward to force outward opposed portions of the heat sealable outface of the blank to expand the sides of the blank, spreading apart the opposed portions of the heat sealable surface of the blank at the open margin opposite the gusset, injecting a flowable substance into the blank at the open margin, and heating and squeezing the blank at the margin opposite the gusset to seal a second selected area of the opposed portions of the heat sealable surface to form a sealed closed pinch pouch.

2. A method of forming, filling and sealing closed individual pinch pouches as defined in claim 1, including the step of preheating the first mentioned selected area of a portion of the heat sealable surface prior to heating and squeezing the material to form a seal in the material extending to the gusset across the direction of movement of the web of material.

3. A method of forming, filling and sealing closed individual pinch pouches as defined in claim 1, including the step of preheating the heat sealable material in the second selected area opposite the gusset prior to heating and squeezing the blank at the second selected area at the margin opposite the gusset to form a sealed closed pinch pouch.

4. A method of forming, filling and sealing closed individual pinch pouches as defined in claim 1, including the step of cooling the margin opposite the gusset after the margin is sealed closed.

5. A method of forming, filling and sealing closed individual pinch pouches as defined in claim 1, including the step of holding apart the portion of the heat sealable surface at the margin opposite the gusset while heating and squeezing the material to form a seal in the material extending to the gusset across the direction of movement of the web of material.

6. A method of forming, filling and sealing closed individual pinch pouches as defined in claim 1, including the step of holding apart the portion of the heat sealable surface adjacent to the margin opposite the gusset, and introducing air under pressure between the portions of the heat sealable surface while heating and squeezing the material at a selected area of the portion of the heat sealable material to form a seal in the material extending to the gusset across the direction of movement of the web of material.

7. A method of forming, filling and sealing closed individual pinch pouches as defined in claim 1, including the step of die cutting the blank at the margin opposite the gusset to define a nozzle for the pinch pouch.

8. A method of forming, filling and sealing closed individual pinch pouches as defined in claim 1, including the step of intermittently moving the web of material.

9. A method of forming, filling and sealing closed individual pinch pouches as defined in claim 1, including the steps of; preheating the first mentioned selected area of a portion of the heat sealable surface prior to heating and squeezing the material to form a seal in the material extending to the gusset across the direction Of movement of the web of material, and preheating the second selected area of the heat sealable surface at the open margin opposite the gusset prior to heating and squeezing the blank at the margin opposite the gusset to form a sealed closed pinch pouch.

10. A method of forming, filling and sealing closed individual pinch pouches as defined in claim 1, including the steps of; preheating the second selected area of the heat sealable surface of the material at the open margin opposite the gusset prior to heating and squeezing the blank at the margin opposite the gusset to form a sealed closed pinch pouch, and cooling the margin opposite the gusset after the margin is sealed closed.

11. A method of forming, filling and sealing closed individual pinch pouches as defined in claim 1, including the steps of; preheating the second selected area of the heat sealable surface of the material at the open margin opposite the gusset prior to heating and squeezing the blank at the margin opposite the gusset to form a sealed closed pinch pouch, and die cutting the blank at the margin opposite the gusset to define a nozzle for the pinch pouch.

12. A method of forming, filling and sealing closed individual pinch pouches as defined in claim 1, including the steps of; cooling the margin opposite the gusset after the margin is sealed closed, and die cutting the blank at the margin opposite the gusset to define a nozzle for the pinch pouch.

13. A method of forming, filling and sealing closed individual pinch pouches as defined in claim 1, including the steps of; preheating the first mentioned selected area of a portion of the heat sealable surface prior to heating and squeezing the material to form a seal in the material extending to the gusset across the direction of movement of the web of material, preheating the second selected area of the material of the heat sealable surface at the open margin opposite the gusset prior to heating and squeezing the blank at the margin opposite the gusset to form a sealed closed pinch pouch, and cooling the heated margin opposite the gusset after the edge is sealed closed.

14. A method of forming, filling and sealing closed individual pinch pouches as defined in claim 1, including the steps of; intermittently moving the web of material, cooling the margin opposite the gusset after the margin is sealed closed, and die cutting the blank at the margin opposite the gusset to define a nozzle for the pinch pouch.

15. A method of forming, filling and sealing closed individual pinch pouches as defined in claim 1, including the steps of; preheating the first mentioned selected area of a portion of the heat sealable surface prior to heating and squeezing the material to form a seal in the material extending to the gusset across the direction of movement of the web of material, preheating the second selected area of the heat sealable surface of the material at the open margin opposite the gusset prior to heating and squeezing the blank at the margin opposite the gusset to form a sealed closed pinch pouch, cooling the material at the margin opposite the gusset after the margin is sealed closed, and die cutting the blank at the margin opposite the gusset to define a nozzle for the pinch pouch.

16. A method of forming, filling and sealing closed individual pinch pouches as defined in claim 1, including the steps of; preheating the first mentioned selected area of the portion of the heat sealable surface prior to heating and squeezing the material to form a seal in the material extending to the gusset across the direction of movement of the web material, preheating the second selected area of the heat sealable surface of the material at the open margin opposite the gusset prior to heating and squeezing the blank at the margin opposite the gusset to form a sealed closed pinch pouch, cooling the material at the margin opposite the gusset after the margin is sealed closed, intermittently moving the web of material and the blank, and die cutting the blank at the margin opposite the gusset to define a nozzle in the pinch pouch.

17. A method of forming, filling and sealing closed individual pinch pouches as defined in claim 1, including the steps of; preheating the first mentioned selected area of the portion of the heat sealable surface prior to heating and squeezing the material to form a seal in the material extending to the gusset across the direction of movement of a web of material, holding apart the portions of the heat sealable surface at the margin opposite the gusset while heating and squeezing the material to form a seal in the material extending to the gusset across the direction of movement of the web of material, preheating the second selected area of the heat sealable surface of the material at the open margin opposite the gusset prior to heating and squeezing the blank at the margin opposite the gusset to form a sealed closed pinch pouch, and cooling the margin opposite the gusset after the margin is sealed closed.

18. A method of forming, filling and sealing closed individual pinch pouches as defined in claim 1, including the steps of; holding apart portions of the heat sealable surface at the margin opposite the gusset and introducing air under pressure between the portions of the heat sealable surface while heating and squeezing the material to form a seal in the material extending to the gusset across the direction of movement of the web of material, cooling the material at the margin opposite the gusset after the margin is sealed closed, and die cutting the blank at the margin opposite the gusset to define a nozzle for the pinch pouch.

19. A method of forming, filling and sealing closed individual pinch pouches as defined in claim 1, including the steps of intermittently moving the web of material and the blank wherein the material has a thickness in excess of seven mils and includes board and the heat sealable surface is polyethylene, holding apart the portions of the heat sealable surface adjacent to the margin opposite the gusset, introducing air under pressure between the portions of the heat sealable surface while heating and squeezing the material to form a seal in the material extending to the gusset across to the direction of movement of the web of material, preheating the first mentioned selected area of the portions of the heat sealable surface prior to heating and squeezing the material to form a seal in the material extending to the gusset across the direction of movement of the web of material, preheating the second selected area of the heat sealable surface of the material at the open margin opposite the gusset prior to heating and squeezing the blank at the margin opposite the gusset to form a sealed closed pinch pouch, cooling the material forming the margin opposite the gusset after the margin is sealed closed, and die cutting the blank in the margin opposite the gusset to define a nozzle for the pinch pouch.

20. An apparatus for forming, filling and sealing closed individual pinch pouches of board material having a thickness greater than 7 mils comprising: a support for holding a continuous supply of web board material having a thickness greater than 7 mils and having a heat sealable surface on one side and indicia on the other side, drive rollers spaced from the support for pulling the material from the supply of web material, folding means positioned between the support and the drive rollers for receiving continuously the web material for folding the web material onto itself in the direction of movement of the material with one portion of the heat sealable surface facing another portion of the heat sealable surface and forming a gusset at a fold between the portions of the heat sealable surface, a heater between the drive rollers and the folding means engageable with the material to fuse selected opposed portions of the heat sealable surface to form a seal between selected limited areas of the opposed portions of the heat sealable surface extending to the gusset across the direction of movement of the web material and terminating prior to an edge opposite the gusset, a carrier adjacent to the drive rollers for receiving the folded material having a seal, a cutter between the carrier and the drive rollers for cutting the material through a seal to form a folded blank having opposed sealed edges extending to the gusset and an open margin opposite the gusset, a hammer adjacent to the cutter for pushing the gusset of the blank to expand the sides of the board material blank inward to spread apart the opposed surfaces of the blank, an opener adjacent to the hammer for holding apart the open margin of the blank, injector means adjacent to the opener for injecting a flowable substance into the blank through the open margin, and sealing means adjacent to the injector means engageable with the blank at the margin opposite the gusset to seal together a selected area of the opposed portions of the heat sealable surface to form a sealed closed pinch pouch.

21. An apparatus for forming, filling and sealing closed individual pinch pouches of board material as defined in claim 20, including; a preheater positioned between the heater and the folding means engageable with the material to preheat the selected opposed portions of the heat sealable surface wherein the seal is formed in the material extending to the gusset across the direction of movement of the web material.

22. An apparatus for forming, filling and sealing closed individual pinch pouches of board material as defined in claim 20, including; a preheater positioned between the injector means and the sealing means for preheating the selected area of the opposed portions of the heat sealable surface of the material at the open margin prior to sealing closed the open margin.

23. An apparatus for forming, filling and sealing closed individual pinch pouches of board material as defined in claim 20, including; a cooler adjacent to the sealing means for cooling the margin of the material opposite the gusset after the margin is sealed closed.

24. An apparatus for forming, filling and sealing closed individual pinch pouches of board material as defined in claim 20, including; a blade adjacent to the heater positioned between opposed heat sealable surfaces at the margin of the material opposite the gusset for holding apart the heat sealable surface at the margin of the material during the formation of the seal across the direction of movement of the web material.

25. An apparatus for forming, filling and sealing closed individual pinch pouches of board material as defined in claim 20, including; a blade adjacent to the heater positioned between opposed portions of the heat sealable surface of the folded material for separating the portions of the heat sealable surfaces at the margin of the material opposite the gusset, and said blade having an air aperture for blowing air between the portions of the heat sealable surface.

26. An apparatus for forming, filling and sealing closed individual pinch pouches of board material as defined in claim 20, including; a cutting die adjacent to the sealing means for cutting the sealed closed margin of the pinch pouch opposite the gusset to define a nozzle in the margin.

27. An apparatus for forming, filling and sealing closed individual pinch pouches of board material as defined in claim 20, including; a detector for identifying indicia on the material and controlling movement of the web material and the blank.

28. An apparatus for forming, filling and sealing closed individual pinch pouches of board material as defined in claim 20, including; a preheater positioned between the heater and the folding means engageable with the material to preheat the area in the material wherein the seal is formed extending to the gusset across the direction of movement of the web material, and a second preheater positioned between the sealing means and the injector for preheating the heat sealable surface of the material at the open margin prior to sealing closed the open margin.

29. An apparatus for forming, filling and sealing closed individual pinch pouches of board material as defined in claim 20, including; a preheater positioned between the sealing means and the injector for preheating the heat sealable surface of the material at the open margin prior to sealing closed the open margin, and a cooler for cooling the margin of the material opposite the gusset after the margin is sealed closed.

30. An apparatus for forming, filling and sealing closed individual pinch pouches of board material as defined in claim 20, including; a preheater positioned between the sealing means and the injector for preheating the material at the open edge prior to sealing closed the open edge, and a die for cutting the sealed closed edge of the pinch pouch opposite the gusset to define a nozzle.

31. An apparatus for forming, filling and sealing closed individual pinch pouches on board material as defined in claim 20, including; a cooler for reducing the temperature of the material at the margin opposite the gusset after the margin is sealed closed, and a die for cutting the sealed closed margin of the pinch pouch opposite the gusset to define a nozzle.

32. An apparatus for forming, filling and sealing closed individual pinch pouches of board material as defined in claim 20, including; a preheater positioned between the heater and the folding means engageable with a portion of the material to preheat the heat sealable surface wherein the seal in the material extending to the gusset across the direction of movement of the web of material is formed, a second preheater positioned between the sealing means and the injector for preheating the heat sealable surface of the material defining the open margin prior to sealing closed the open margin and a cooler for cooling the material of the margin opposite the gusset after the margin is sealed closed.

33. An apparatus for forming, filling and sealing closed individual pinch pouches on board material as defined in claim 20, including; a detector for identifying indicia on the side of the material for controlling the movement of the web material and the blank, a cooler for cooling the material of the margin opposite the gusset after the margin is sealed closed, and a die cutting the sealed closed margin of the pinch pouch opposite the gusset to define a nozzle.

34. An apparatus for forming, filling and sealing closed individual pinch pouches of board material as defined in claim 20, including; a preheater engageable with the material to preheat a portion of the heat sealable surface in the area wherein the seal is formed in the material extending to the gusset across the direction of movement of the web material, a second preheater for preheating the heat sealable surface in the material defining the open margin prior to sealing closed the open margin, a cooler for cooling the material of the margin opposite the gusset after the margin is sealed closed, and a die for cutting the sealed closed margin of the pinch pouch opposite the gusset to define a nozzle.

35. An apparatus for forming, filling and sealing closed individual pinch pouches of board material as defined in claim 20, including; a detector for identifying indicia on the material for controlling movement of the web material and the blank, a preheater engageable with the material to preheat the heat sealable surface in the area wherein the seal is formed in the material extending to the gusset across the direction of movement of the web material, a second preheater for preheating the heat sealable surface of the material defining the open margin prior to sealing closed the open margin, a cooler for cooling the material of the margin opposite the gusset after the margin is sealed closed, and a die for cutting the sealed closed margin of the pinch pouch opposite the gusset to define a nozzle.

36. An apparatus for forming, filling and sealing closed individual pinch pouches of board material as defined in claim 20, including; a blade adjacent to the heater positioned between opposed surfaces of the material opposite the gusset for holding apart the material opposite the gusset during the formation of the seal across the direction of movement of the web material, a preheater engageable with the material to preheat the heat sealable surface in the area wherein the seal is formed in the material extending to the gusset across the direction of movement of the web material, a second preheater for preheating the heat sealable surface of the material defining the open margin prior to sealing closed the open margin, and a cooler for cooling the margin of the material opposite the gusset after the margin is sealed closed.

37. An apparatus for forming, filling and sealing closed individual pinch pouches of board material as defined in claim 20, including; a blade adjacent to the heater positioned between opposed edges of the folded material for separating the margins of the material opposite the gusset, means blowing air through the blade into a space between the margins, a preheater engageable with the material to preheat the heat sealable surface of the material in the area wherein the seal is formed in the material extending through the gusset across the direction of movement of the web material, a second preheater for preheating the heat sealable surface of the material defining the open margins prior to sealing closed the open margins, a cooler for cooling the material defining the margin opposite the gusset after the margin is sealed closed, and a die for cutting the sealed closed margin of the pinch pouch opposite the gusset to define a nozzle.

38. An apparatus for forming, filling and sealing closed individual pinch pouches of board material as defined in claim 20, including; a detector for identifying indicia on the material and controlling the movement of the web material and blank wherein the material has a thickness of at least seven mils and includes board with the heat sealable surface being polyethylene, a blade adjacent to the heater positioned between opposed portions of the material for separating the opposed margins of the material opposite the gusset, an air aperture in the blade to allow air under pressure to be delivered between the opposed margins, a preheater positioned between the heater and the folding means engageable with the material to preheat the polyethylene in the area wherein the seal is formed in the material extending to the gusset across the direction of movement of the web material, a second preheater positioned between the sealing means and the injector for preheating the polyethylene of the material defining the open margin prior to sealing closed the open margin, a cooler for reducing the temperature of the material of the margin opposite the gusset after the margin is sealed closed, and a die for cutting the sealed closed margin of the pinch pouch opposite the gusset to define a nozzle.

* * * * *

UNITED STATES PATENT AND TRADEMARK OFFICE

CERTIFICATE OF CORRECTION

PATENT NO. : 5,353,573

DATED : October 11, 1994

INVENTOR(S) : William J. Durrant

It is certified that error appears in the above-identified patent and that said Letters Patent is hereby corrected as shown below:

Column 6, Line 26, delete -- Of -- and insert -- of --.

Signed and Sealed this

Twenty-ninth Day of November, 1994

*Attest:*

*Attesting Officer*

Bruce Lehman

BRUCE LEHMAN

*Commissioner of Patents and Trademarks*